US006280252B1

(12) United States Patent
Huang

(10) Patent No.: US 6,280,252 B1
(45) Date of Patent: Aug. 28, 2001

(54) ELECTRICAL CONNECTOR FIRMLY RETAINING AN INSULATIVE HOUSING

(75) Inventor: Nan Tsung Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/492,251

(22) Filed: Jan. 27, 2000

(51) Int. Cl.[7] ..... H01R 13/648
(52) U.S. Cl. ..... 439/610
(58) Field of Search ..... 439/606–610

(56) References Cited

U.S. PATENT DOCUMENTS

| | | | | |
|---|---|---|---|---|
| 5,425,657 | * | 6/1995 | Davis et al. | 439/610 |
| 5,683,269 | * | 11/1997 | Davis et al. | 439/607 |
| 6,039,606 | * | 3/2000 | Chiou | 439/610 |
| 6,062,907 | * | 5/2000 | Tan et al. | 439/610 |

* cited by examiner

*Primary Examiner*—Gary F. Paumen
(74) *Attorney, Agent, or Firm*—Wei Te Chung

(57) ABSTRACT

A cable connector comprises an insulative housing defining a plurality of passageways, a plurality of terminals received in the passageways of the insulative housing, an upper shell, a lower shell and a casing portion enveloping the upper shell and the lower shell therein. The insulative housing includes a main body and a projection portion forwardly projecting from the main body. The upper shell includes a front section for receiving the projection portion therein, a rear section receiving the main body therein and a transition portion for joining the front section and rear section. A rib is provided at a junction of the transition portion and the rear section for enhancing the engagement strength of the transition portion and the rear section of the upper shell. A top protrusion and a pair of side protrusions are disposed on the rear section of the upper shell for abutting against the insulative housing. The lower shell has a latching hook upwardly extending from a forward edge of a bottom wall thereof for pressing against the forward surface of the main body of the insulative housing.

1 Claim, 3 Drawing Sheets

ELECTRICAL CONNECTOR FIRMLY RETAINING AN INSULATIVE HOUSING

BACKGROUND OF THE INVENTION

The present invention relates to an electrical connector having a pair of shells which firmly retain an insulative housing therein and which can be conveniently manufactured, and particularly to a mini USB cable connector having a pair of shells for enclosing the insulative housing therein, thereby providing EMI shielding.

Electrical connectors commonly used for electrically connecting cable, and although they may solve the problem of connecting the cables, they simultaneously producing a variety of other problems about the electrical connectors. These other problems include generation of and vulnerability to electromagnetic interference (EMI). EMI problems are normally overcome by use of shielding, but reliably attaching an EMI shield to a connector housing is a problem since the shield must endure a large insertion force from a mating connector. Conventional electrical connectors are illustrated in U.S. Pat. Nos. 5,683,269 and 5,425,657. An electrical connector, as shown in FIG. 3, comprises a housing 24 containing contacts therein, a cover block member 32 for holding cable conductors, and a pair of metal backshells 26 and 28 fastened together over the cover block member 32 and the housing 24. A pair of locking tabs 261 of a pair of first projections 260 of the backshell 26 latch with a pair of locking holes 281 of a pair of second projections 280 of the backshell 28, the first and the second projections 260 and 280 together abutting against opposite sides 241 of the housing 24. However, the projections 260 and 280 are inconvenient to manufacture and can not reliably retain the housing 24 in a fixed position in the backshells 26 and 28.

BRIEF SUMMARY OF THE INVENTION

A main object of the present invention is to provide a cable connector which can be conveniently manufactured and has a pair of shells for accurately positioning and reliably enclosing an insulative housing therein.

Another object of the present invention is to provide a cable connector having a pair of shells which firmly engage with each other for providing strain relief and shielding against EMI.

A cable connector according to the present invention comprises an insulative housing defining a plurality of passageways therethough, a plurality of terminals received in the passageways of the insulative housing, an upper shell, a lower shell and a casing portion enveloping the upper shell and the lower shell. The insulative housing includes a main body and a projection portion forwardly projecting from the main body. The main body has a forward surface defining a pair of apertures and a lower opening therein.

The upper shell includes a front section for receiving the projection portion of the insulative housing, a rear section having a top wall and a pair of opposite lateral walls, and a transition portion connecting the front section to the rear section. The rear section forms a top protrusion and a pair of side protrusions respectively disposed on the top wall and on each lateral wall for abutting against the insulative housing. The transition portion of the upper shell downwardly depends from a forward edge of the top wall of the rear section for joining the front section with the rear section. A rib is provided at substantially a middle of a junction of the top wall of the rear section and the transition portion for enhancing the engagement strength of the transition portion and the rear section of the upper shell. A pair of retention arms depend rearwardly from opposite side edges of the transition portion and is retained in the corresponding apertures of the main body of the insulative housing.

The lower shell has a latching hook upwardly depending from a forward edge of a bottom wall thereof for latching with the lower opening of the main body of the insulative housing. The upper shell and lower shell interlock with one another, tightly retaining the insulative housing therein.

Other objects, advantages and novel features of the invention will become more apparent from the following detailed description when taken in conjunction with the accompanying drawings.

DETAILED DESCRIPTION OF THE INVENTION

Figure 1:
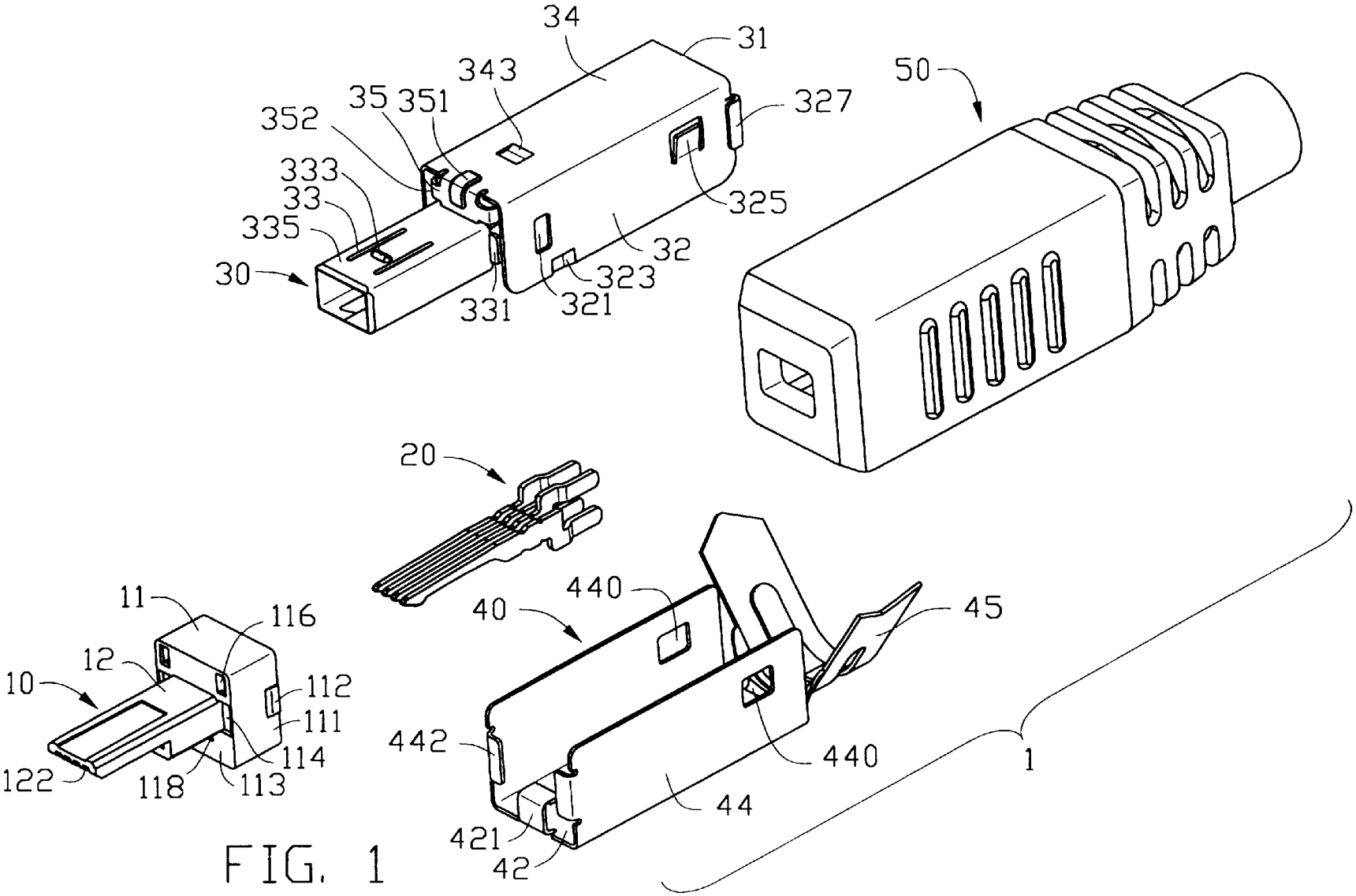
FIG. 1 is an exploded view of a cable connector of the present invention.
Figure 2:
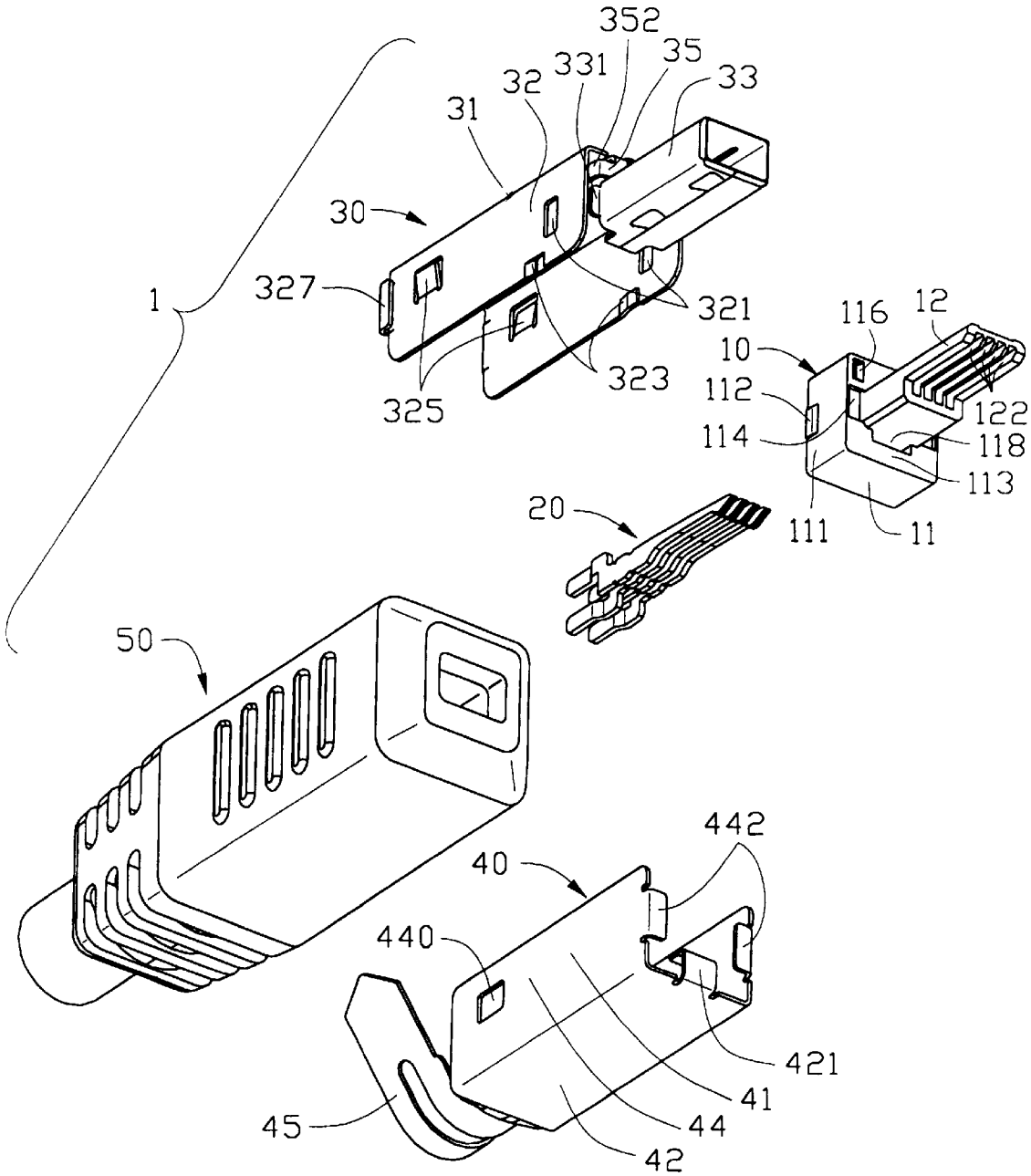
FIG. 2 is a cable connector of FIG. 1 viewed from another aspect.
Figure 3:
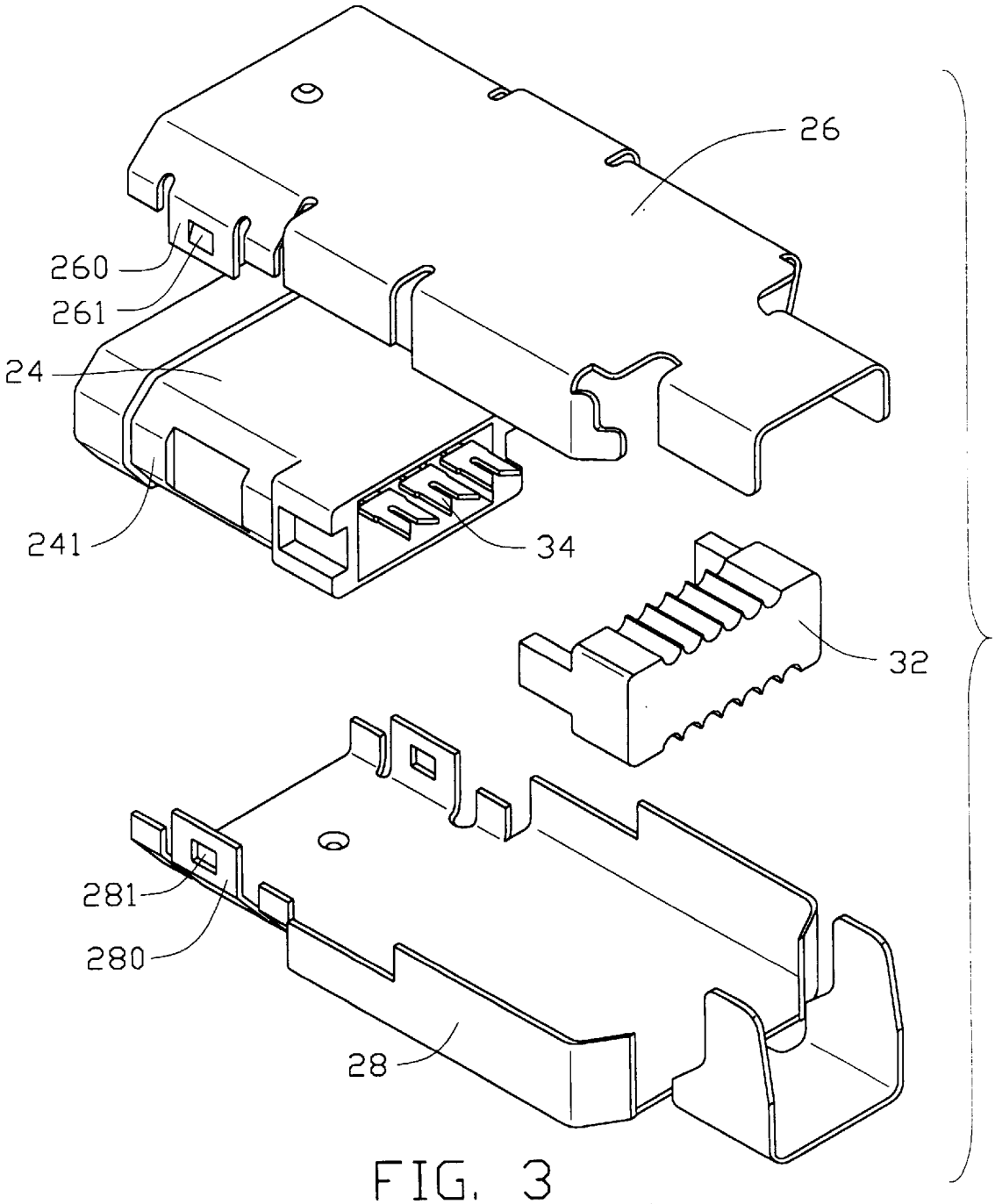
FIG. 3 (PRIOR ART)
FIG. 3 is an exploded view of a conventional electrical connector.

Referring to FIGS. 1 and 2, a cable connector 1 in accordance with the present invention comprises an insulative housing 10, four terminals 20 received in the insulative housing 10, an upper shell 30 integrally formed, a lower shell 40 integrally formed and a casing portion 50 enveloping the upper shell 30 and the lower shell 40. The insulative housing 10 includes a substantially rectangular main body 11 having a forward surface 113 and a pair of side surfaces 111, and a projection portion 12 forwardly projecting from the forward surface 113 of the main body 11. The main body 11 and the projection portion 12 longitudinally define four passageways 122 therein for respectively receiving four terminals 20. A pair of apertures 116 are defined in an upper portion of the forward surface 113. A pair of side recesses 114 and a lower opening 118 are defined in the forward surface 113 of the main body 11 respectively adjacent to a side and a bottom of the projection portion 12. Each side surface 111 of the main body 11 disposes a locking tab 112 in the vicinity of a rear edge thereof.

The upper shell 30 comprises a rear section 31 having a top wall 34 and a pair of lateral walls 32, a front section 33 for receiving the projection portion 12 of the insulative housing 10 and a transition portion 35 downwardly depending from a forward edge of the top wall 34. The transition portion 35 joins the front section 33 to the rear section 31. A rib 351 is provided at substantially a middle of a junction position of a forward edge of the top wall 34 of the rear section 31 and the transition portion 35 for enhancing the engagement strength of the transition portion 35 and the rear section 31 of the upper shell 30. A pair of retention arms 352 rearwardly depend from opposite edges of the transition portion 35 of the upper shell 30 and is retained in apertures 116 of the main body 11 of the insulative housing 10. The front section 33 of the upper shell 30 defines a pair of slits 335 in an upper face thereof and disposes an embossment 333 between the slits 335 for engaging with the casing portion 50. A pair of side flanges 331 outwardly depend from rear edges of opposite sides of the front section 33 for being received in side recesses 114 of the main body 11 of the insulative housing 10. The top wall 34 downwardly disposes a top protrusion 343 thereon, and each lateral wall 32 inwardly disposes a side protrusion 323 thereon for abutting against the insulative housing 10. Each lateral wall 32 of the rear section 31 includes a locking tongue 325 at a rear portion thereof and a locking tail 327 outwardly curling from a rear edge thereof. A locking opening 321 is defined in each lateral wall 32 of the rear section 31 of the upper shell 30 for receiving the corresponding locking tab 112 of the main body 11 of the insulative housing 10.

The lower shell 40 comprises a main section 41 having a bottom wall 42 and a pair of side walls 44 and an arcuate strain relief 45 for holding a cable. A latching hook 421 upwardly extends from substantially a middle of a front edge of the bottom wall 42 of the lower shell 40 for latching with the lower opening 118 of the main body 11 of the insulative housing 10. A latching arm 442 inwardly depends from a forward edge of each side wall 44 of the lower shell 40 for pressing against the forward surface 113 of the main body 11 of the insulative housing 10. A latching hole 440 is defined in each side wall 44 of the main section 41 of the lower shell 40 for receiving the locking tongue 325 of the rear section 31 of the upper shell 30.

During assembly, the terminals 20 are first inserted into the passageways 122 of the projection portion 12 of the insulative housing 10. The projection portion 12 of the insulative housing 10 is received in the front section 33 of the upper shell 30. The upper shell 30 and the lower shell 40 engage with each other to enclose the main body 11 of the insulative housing 10 therein, the lateral walls 32 of the upper shell 30 contacting the side walls 44 of the lower shell 40. The retention arms 352 of the transition portion 35 are retained in the apertures 116 of the main body 11 of the insulative housing 10. The side flanges 331 of the front section 33 of the upper shell 30 are received in the side recesses 114 of the main body 11 of the insulative housing 10. The locking openings 321 of the upper shell 30 receive the locking tabs 112 of the main body 11 of the insulative housing 10. The top protrusion 343 of the top wall 34 and the side protrusion 323 of the lateral walls 32 of the upper shell 30 respectively abut against the main body 11 of the insulative housing 10. The latching hook 421 of the main section 41 of the lower shell 40 is held in the lower opening 118 of the main body 11 of the insulative housing 10. The latching arms 442 press against the forward surface 113 of the main body 11 of the insulative housing 10, and also press against the side flanges 331 of the upper shell 30. The locking tongues 325 of the lateral walls 32 of the rear section 31 of the upper shell 30 are embedded in the latching holes 440 of the side walls 44 of the lower shell 40. The locking tails 327 latch with opposite rearward edges of the side walls 44 of the lower shell 40. Thus, the upper shell and the lower shell 40 are firmly fastened to each other, and the insulative housing 10 is reliably secured in the upper shell 30 and the lower shell 40. Finally, the upper shell 30 and the lower shell 40 are enclosed in the casing portion 50. The projection portion 12 of the insulative housing 10 extends out of the casing portion 50 for plugging into a mating electrical connector (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an insulative housing including a main body and a projection portion together defining a plurality of passageways, the main body defining a pair of apertures and a lower opening in a forward surface thereof;

a plurality of terminals received in the passageways of the insulative housing;

an upper shell including a front section for accommodating the projection portion of the insulative housing, a rear section and a transition portion interconnected between the front section and the rear section, a pair of retention arms rearwardly extending from opposite edges of the transition portion for latching with the apertures in the main body of the insulative housing, a top protrusion and a pair of side protrusions being respectively disposed on a top wall and on opposite lateral walls of the rear section for abutting against the insulative housing, a locking tail outwardly extending from a rear edge of each lateral wall of the rear section of the upper shell;

a lower shell fastened to the rear section of the upper shell for enclosing the insulative housing therein, the lower shell having a main section with a pair of side walls and a bottom wall, a latching hook upwardly extending from a front edge of the bottom wall of the main section for latching with the lower opening in the main body of the insulative housing; and a casing portion enveloping the upper shell and the lower shell;

wherein a rib is disposed at a junction of the rear section and the transition portion for enhancing the engagement strength of the transition portion and the rear section of the upper shell;

wherein the front section of the upper shell defines a pair of slits in an upper face thereof and has an embossment between the slits for tightly engaging with a mating electrical connector;

wherein each locking tail of the rear section of the upper shell latches with a rear edge of each side wall of the main section of the lower shell;

wherein a pair of side recesses are respectively defined in the forward surface of the main body of the insulative housing, a pair of side flanges outwardly depend from rear edges of opposite sides of the front section of the upper shell and are received in the side recesses of the main body of the insulative housing, and a latching arm inwardly depends from a forward edge of each side wall of the lower shell for pressing against the forward surface of the main body of the insulative housing;

wherein a locking tab is disposed on each side surface of the main body in the vicinity of a rear edge thereof, a locking opening is defined in each lateral wall of the rear section of the upper shell for receiving the locking tab of the main body of the insulative housing;

wherein each lateral wall of the rear section of the upper shell has a locking tongue at a rear portion thereof, each side wall of the main section of the lower shell defines a latching hole therein for receiving the locking tongue of the rear section of the upper shell;

wherein the lower shell comprises a strain relief rearwardly extending from a rear edge of the bottom wall of the main section for holding a cable.

* * * * *